US006126270A

United States Patent [19]

Lebens et al.

[11] Patent Number: 6,126,270

[45] Date of Patent: Oct. 3, 2000

[54] IMAGE FORMING SYSTEM AND METHOD

[75] Inventors: John A. Lebens, Rush; Ravi Sharma, Fairport; Christopher N. Delametter, Rochester, all of N.Y.

[73] Assignee: Eastman Kodak Company, Rochester, N.Y.

[21] Appl. No.: 09/017,827

[22] Filed: Feb. 3, 1998

[51] Int. Cl.[7] ..... B41J 2/214; B41J 2/06

[52] U.S. Cl. ..... 347/48; 347/55

[58] Field of Search ..... 347/48, 21, 20, 347/70, 55, 51

[56] References Cited

U.S. PATENT DOCUMENTS

| | | | |
|---|---|---|---|
| 3,946,398 | 3/1976 | Kyser et al. | 347/70 |
| 5,726,693 | 3/1998 | Sharma et al. | 347/48 |
| 5,880,759 | 3/1999 | Silverbrook | 347/48 |

FOREIGN PATENT DOCUMENTS 2007162 3/1979 United Kingdom .

WO 90/14233 11/1990 WIPO .

*Primary Examiner*—John Barlow
*Assistant Examiner*—Juanita Stephens
*Attorney, Agent, or Firm*—Walter S. Stevens

[57] ABSTRACT

Image forming system and system. The method comprises a transducer for pressurizing and depressurizing an ink body so that an ink meniscus alternately extends from the ink body as the ink body is pressurized to form a neck portion thereof and retracts as the ink body is depressurized. An ink droplet separator is is in communication with the neck portion of the meniscus for lowering surface tension of the neck portion of the meniscus. In this regard, the droplet separator lowers the surface tension of the meniscus as the meniscus extends from the ink body. The extended meniscus severs from the ink body to form an ink droplet as the droplet separator lowers the surface tension of the neck portion to a predetermined value and as the ink meniscus retracts during depressurization of the ink body.

44 Claims, 9 Drawing Sheets

IMAGE FORMING SYSTEM AND METHOD

BACKGROUND OF THE INVENTION

This invention generally relates to printing devices and methods, and more particularly relates to an image forming system and method for forming an image on a recording medium, the system including a thermo-mechanically activated DOD (Drop On Demand) printhead which conserves power.

BACKGROUND ART

Ink jet printing is recognized as a prominent contender in digitally controlled, electronic printing because of its non-impact, low-noise characteristics, use of plain paper and avoidance of toner transfers and fixing. For these reasons, DOD (Drop-On-Demand) inkjet printers have achieved commercial success for home and office use.

For example, U.S. Pat. No. 3,946,398, which issued to Kyser et al. in 1970, discloses a drop-on-demand ink jet printer which applies a high voltage to a piezoelectric crystal, causing the crystal to bend. As the crystal bends pressure is applied on an ink reservoir for jetting ink drops on demand. Other types of piezoelectric drop-on-demand printers utilize piezoelectric crystals in push mode, shear mode, and squeeze mode. However, the patterning of piezoelectric crystal and the complex high voltage drive circuitry necessary to drive each printer nozzle are disadvantageous to cost effective manufacturability and performance. Also, the relatively large size of the piezo transducer prevents close nozzle spacing making it difficult for this technology to be used in high resolution page width printhead design.

Great Britain Pat. No. 2,007,162, which issued to Endo et al. in 1979, discloses an electrothermal drop-on-demand ink jet printer that applies a power pulse to an electrothermal heater which is in thermal contact with water based ink in a nozzle. A small quantity of ink rapidly evaporates, forming a bubble which causes drops of ink to be ejected from small apertures along an edge of a heater substrate. This technology is known as thermal ink jet printing.

More specifically, thermal ink jet printing typically requires a heater energy of approximately 20 $\mu$J over a period of approximately 2 $\mu$sec to heat the ink to a temperature 280–400° C. to cause rapid, homogeneous formation of a bubble. The rapid bubble formation provides momentum for drop ejection. Collapse of the bubble causes a pressure pulse on the thin film heater materials due to the implosion of the bubble. The high temperatures needed with this device necessitates the use of special inks, complicates driver electronics, and precipitates deterioration of heater elements through kogation, which is the accumulation of ink combustion by-products that encrust the heater with debris. Such encrusted debris interferes with thermal efficiency of the heater. In addition, such encrusted debris may migrate to the ink meniscus to undesirably alter the viscous and chemical properties of the ink meniscus. Also, the 10 Watt active power consumption of each heater prevents manufacture of low cost, high speed pagewidth printheads.

An inkjet printing system is disclosed in commonly assigned U.S. patent application Ser. No. 08/621,754 filed on Mar. 22, 1996, in the name of Kia Silverbrook. The Silverbrook device provides a liquid printing system incorporating nozzles having a meniscus poised at positive pressure extending from the nozzle tip. A heater surrounding the nozzle tip applies heat to the edge of the meniscus. This technique provides a drop-on-demand printing mechanism wherein the means of selecting drops to be printed produces a difference in position between selected drops and drops which are not selected, but which is insufficient to cause the ink drops to overcome the ink surface tension and separate from the body of ink. In this regard, an additional means is provided to cause separation of the selected drops from the body of ink. A method of selection that uses surface tension reduction requires specialized inks and the requirement of poising the meniscus at a positive pressure causes catastrophic failure from nozzle leakage due to contamination on any single nozzle. Application of an electric field or the adjustment of receiver proximity is thereafter used to cause separation of the selected drops from the body of the ink. However, the electric field strength needed to separate the selected drop is above the value for breakdown in air so that a close spacing between nozzle and receiver is needed, but there is still the possibility of arcing. Causing separation of the drop using proximity mode, for which the paper receiver must be in close proximity to the orifice in order to separate the drop from the orifice, is unreliable due to the presence of relatively large dust particles typically found in an uncontrolled environment.

Each of the above-described ink jet printing systems has advantages and disadvantages. However, there remains a widely recognized need for an improved ink jet printing approach, providing such advantages as reduced cost, increased speed, higher quality, greater reliability, less power usage, and simplicity of construction and operation. The invention, which includes a thermomechanically activated DOD (Drop On Demand) printhead, obtains such advantages over prior art systems.

Therefore, there has been a long-felt need to provide an image forming system and method for forming an image on a recording medium, which system is capable of conserving power.

SUMMARY OF THE INVENTION

The invention resides in an image forming system and method comprising a transducer for pressurizing an ink body so that an ink meniscus extends from the ink body, the meniscus having a predetermined surface tension. The invention further comprises an ink droplet separator associated with the transducer for lowering the surface tension of the meniscus as the meniscus extends from the ink body. The droplet separator separates the meniscus from the ink body to form an ink droplet due to the droplet separator lowering the surface tension of the ink meniscus.

In a preferred embodiment of the invention, a pressure transducer to periodically oscillates the meniscus which extends from the ink body and an ink droplet separator associated with a heater alters material properties of the ink resulting in a reduction in the surface tension of the ink in a neck region of the extended meniscus. The timely application of a heat pulse increases the instability of the meniscus in the neck region, thereby causing separation of the meniscus from the ink body to form an ink droplet.

In brief, the image forming system of the present invention comprises a printhead including a plurality of nozzles, each nozzle having a nozzle orifice and defining a chamber having an ink body therein in communication with the orifice. In fluid communication with all the ink bodies is a single oscillatable piezoelectric transducer for alternately pressurizing and depressurizing the ink bodies. When the ink bodies are pressurized, a plurality of ink menisci extend from respective ones of the orifices and when the ink bodies are depressurized, the menisci retract into the respective ones of the orifices. As each meniscus is pushed out by a positive pressure wave, a slight necking is seen before the drop is retracted back in the nozzle by a negative pressure wave. In fact, increasing the amplitude of the pressure wave by a predetermined amount (e.g., 20%) above preferred operating conditions causes complete necking of the meniscus and ejection of the drop. A timely application of electrothermal pulses to an annular heater located around the rim of each nozzle increases the necking instability for selected nozzles producing ejection of the drop, thereby propelling it to a receiver. The electrothermal pulse applied to the annular heater causes a heating of the drop in the neck region; thereby altering material properties of the ink, including a reduction in the surface tension of the ink in the neck region which increases the necking instability. That is, at a point in time when the oscillating menisci are extended, predetermined ones of the heaters are selectively activated to lower surface tension of predetermined ones of the menisci. In this regard, the selected heaters deliver a relatively small pulse of heat energy to the predetermined ones of the extended menisci so that the predetermined ones of the extended menisci further extend from their orifices. Each of these menisci forms the previously mentioned necked region of reduced diameter.

When the meniscus is at or near peak extension from the nozzle during the pressurization portion of the droplet separation cycle, there is net flow of ink outwardly from the nozzle. In addition, because the heater is in heat transfer communication with the meniscus and because, during pressurization, pressure generated by the transducer forces the heated meniscus towards the surface of the nozzle, most of the thermal energy is utilized to keep the nozzle's exterior surface at an elevated temperature. In this manner, a relatively small amount of thermal energy is lost to the ink body and nozzle substrate. Such relatively minimal thermal energy loss obtains increased energy efficiency for the printhead. Moreover, the ink in the nozzle orifice area remains relatively cool and the nozzle orifice remains clean of residue, thus preventing undesired misfiring of the nozzles.

An object of the present invention is to provide an image forming system and method for forming an image on a recording medium, the system including a thermomechanically activated DOD (Drop On Demand) printhead which conserves power.

A feature of the present invention is the provision of a single oscillating piezoelectric transducer in fluid communication with a plurality of ink menisci reposed at respective ones of a plurality of nozzles for alternately pressurizing and depressurizing the menisci, so that the menisci extend from the nozzle as the menisci are pressurized and retract into the nozzle as the menisci are depressurized.

Another feature of the present invention is the provision of a plurality of heaters in heat transfer communication with respective ones of the ink menisci, the heaters being selectively actuated only as the menisci extend a predetermined distance from the nozzles for separating selected ones of the menisci from their respective nozzles.

Another advantage of the present invention is that use thereof increases reliability of the printhead.

Another advantage of the present invention is that use thereof conserves power.

Yet another advantage of the present invention is that the heaters belonging thereto are longer-lived.

A further advantage of the present invention is that use thereof allows more nozzles per unit volume of the printhead to increase image resolution.

An additional advantage of the present invention is that use thereof allows faster printing.

Still another advantage of the present invention is that a vapor bubble is not formed at the heater, which vapor bubble formation might otherwise lead to kogation.

These and other objects, features and advantages of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figures 1, 1A:
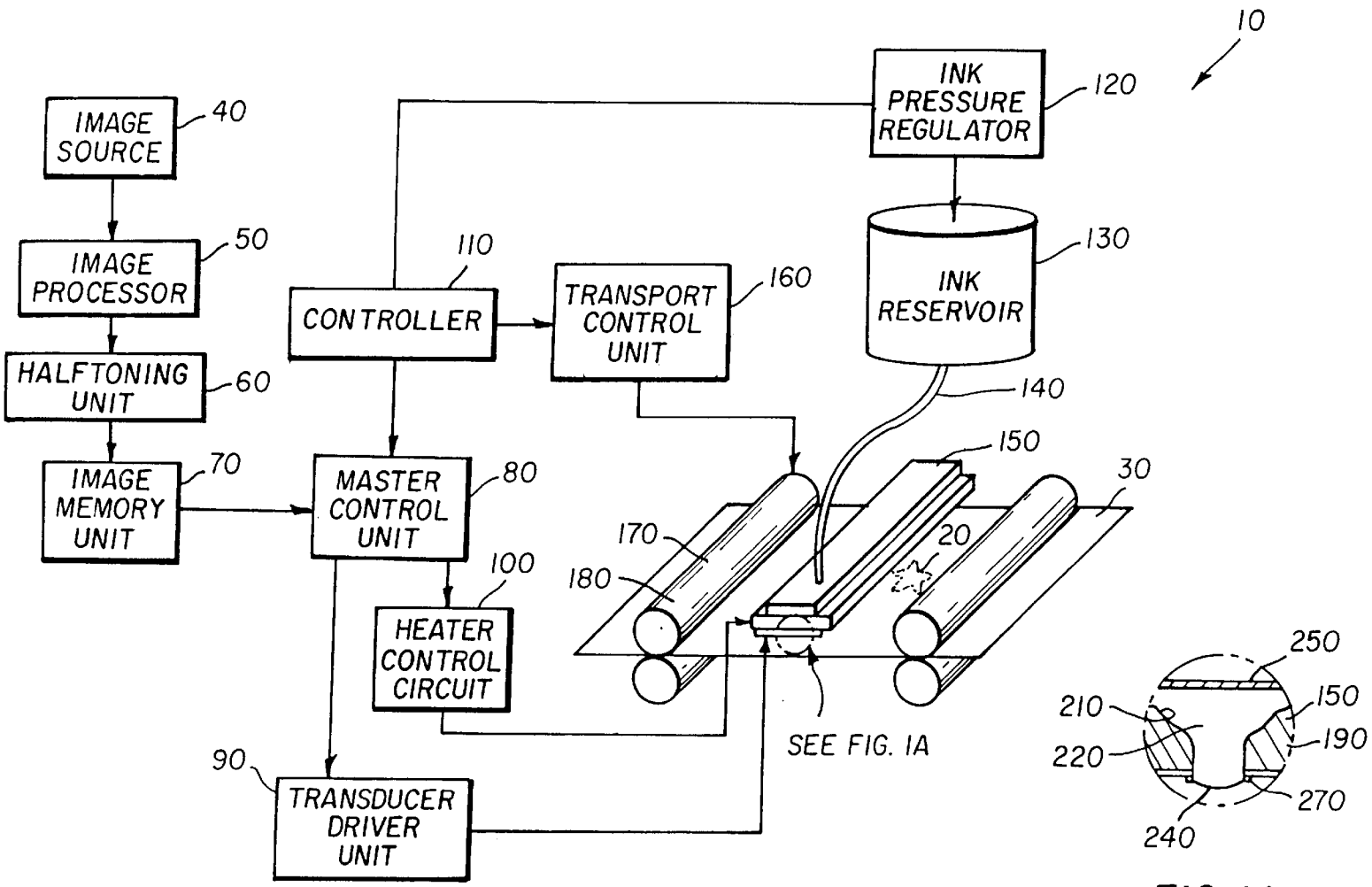
FIG. 1 shows a functional block diagram of an image forming system according to the present invention.

Therefore, referring to FIG. 1, there is shown a functional block diagram of an image forming system, generally referred to as 10, for forming an image 20 on a recording medium 30. Recording medium 30 may be, for example, cut sheets of paper or transparency. As described in detail hereinbelow, system 10 includes a thermo-mechanically activated DOD (Drop-On-Demand) inkjet printhead which conserves power.

Still referring to FIG. 1, system 10 comprises an input image source 40, which may be raster image data from a scanner (not shown) or computer (also not shown), or outline image data in the form of a PDL (Page Description Language) or other form of digital image representation. Image source 40 is connected to an image processor 50, which converts the image data to a pixel-mapped page image comprising continuous tone data. Image processor 50 is in turn connected to a digital halftoning unit 60 which halftones the continuous tone data produced by image processor 50. This halftoned bitmap image data is temporarily stored in an image memory unit 70 connected to halftoning unit 60. Depending on the configuration selected for system 10, image memory unit 70 may be a full page memory or a so-called band memory. For reasons described more fully hereinbelow, output data from image memory unit 70 is read by a master control circuit 80, which controls both a transducer driver circuit 90 and a heater control circuit 100.

Referring again to FIG. 1, system 10 further comprises a microcontroller 110 connected to master control circuit 80 for controlling master control circuit 80. As previously mentioned, control circuit 80 in turn controls transducer driver circuit 90 and heater control circuit 100. Controller 110 is also connected to an ink pressure regulator 120 for controlling regulator 120. A purpose of regulator 120 is to regulate pressure in an ink reservoir 130 connected to regulator 120, which reservoir 130 contains a reservoir of ink therein for marking recording medium 30. Ink reservoir 130 is connected, such as by means of a conduit 140, to a printhead 150, which may be a DOD inkjet printhead. In addition, connected to controller 110 is a transport control unit 160 for electronically controlling a recording medium transport mechanism 170. Transport mechanism 170 may include a plurality of motorized rollers 180 aligned with printhead 150 and adapted to intimately engage recording medium 30. In this regard, rollers 180 rotatably engage recording medium 30 for transporting recording medium 30 past printhead 150. It may be understood that for the purpose of so-called "pagewidth" printing, printhead 150 remains stationary and recording medium 30 is moved past stationary printhead 150. On the other hand, for the purpose of so-called "scanning-type" printing, printhead 150 is moved along one axis (in a sub-scanning direction) and recording medium 30 is moved along an orthogonal axis (in a main scanning direction), so as to obtain relative raster motion.

Figure 2:
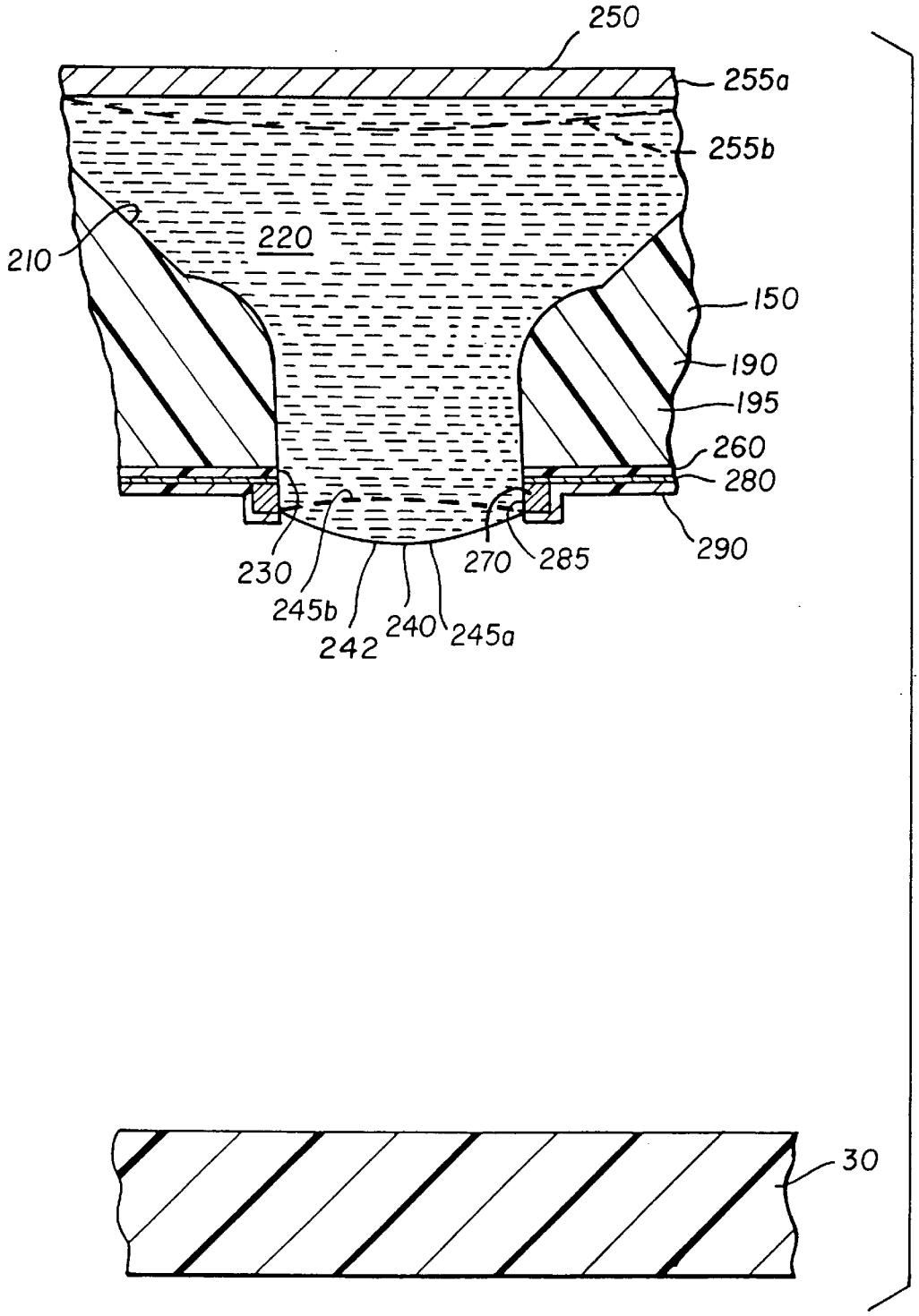
FIG. 2 is a view in vertical section of a printhead nozzle belonging to the image forming system of the present invention, the nozzle having an ink body therein and an ink meniscus connected to the ink body.
Figure 5:
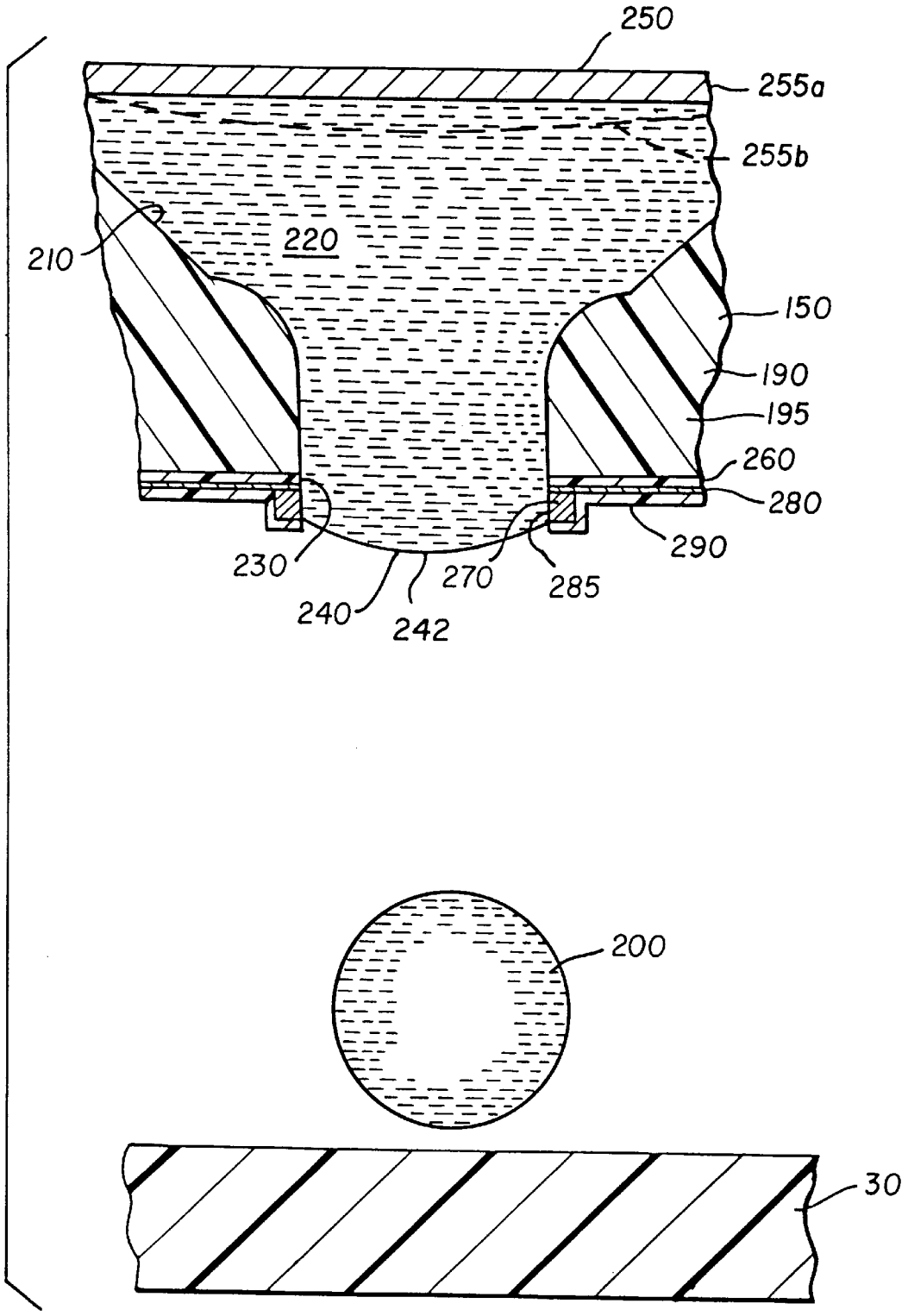
FIG. 5 is a view in vertical section of the nozzle, the meniscus having been severed from the nozzle so as to define a generally spherically-shaped ink droplet traveling toward a recording medium.

Turning now to FIG. 2, printhead 150 comprises a plurality of nozzles 190 (only one of which is shown), each nozzle 190 capable of ejecting an ink droplet 200 (see FIG. 5) therefrom to be intercepted by a receiver such as recording medium 30. As shown in FIG. 2, each nozzle 190 is etched in an orifice plate or substrate 195, which may be silicon, and defines a channel-shaped chamber 210 in nozzle 190. Chamber 210 is in communication with reservoir 130, such as by means of previously mentioned conduit 140, for receiving ink from reservoir 130. In this manner, ink flows through conduit 140 and into chamber 210 such that an ink body 220 is formed in chamber 210. In addition, nozzle 190 defines a nozzle orifice 230 communicating with chamber 210. An ink meniscus 240 is disposed at orifice 230 when ink body 220 is disposed in chamber 210. In this position of ink meniscus 240, the ink meniscus 240 has a surface area 242. By way of example only and not by way of limitation, orifice 230 may have a radius of approximately 8 $\mu$m.

Referring again to FIG. 2, in the absence of an applied heat pulse, the meniscus 240 is capable of oscillating between a first position 245*b* (shown, for example, as a dashed curved line) and an extended meniscus second position 245*a*. In this position of ink meniscus 240, the ink meniscus 240 has an expanded surface area 247 and defines an extended ink meniscus body 248 having a posterior portion 249. It may be appreciated that, in order for meniscus 240 to oscillate, ink body 220 must itself oscillate because meniscus 240 is integrally formed with ink body 220, which ink body 220 is a substantially incompressible fluid. To oscillate each ink body 220, a single or unitary oscillatable piezoelectric transducer 250 spans chambers 210 and is in fluid communication with all ink bodies 220 in chambers 210. In the preferred embodiment of the invention, piezoelectric transducer 250 is capable of accepting, for example, a 25 volt, 50 $\mu$s square wave electrical pulse, although other pulse shapes, such as triangular or sinusoidal may be used, if desired. Transducer 250 is capable of deforming so as to evince oscillatory motion from its unstressed position 255*a* to a concave inwardly-directed position 255*a*. More specifically, when transducer 250 moves to concave inward position 255*a*, volume of chamber 210 decreases and meniscus 240 is extended outward from orifice 230 as shown by position 245*a*. Similarly, when transducer 250 returns to its unstressed position 255*a*, volume of chamber 210 returns to its initial state and ink is retracted into nozzle with meniscus 240 returning to concave first position 245*b*. As described hereinabove, transducer 250 preferably spans all chambers 210 and therefore simultaneously pressurizes and depressurizes all chambers 210. Such a piezoelectric transducer 250 may be selected so that it deflects in shear mode or transducer 250 may be selected so that it deflects in non-shear mode, if desired. By way of example only, and not by way of limitation, transducer 250 preferably pressurizes chamber 210 to a pressure of approximately 3–5 lbs./in$^2$ gauge and preferably depressurizes chamber 210 to a pressure of approximately negative 2–5 lbs./in$^2$ gauge. Thus, meniscus 240 does not experience a static (i.e., constant) back pressure. Rather, chamber 210 and therefore ink body 220 experience a dynamic pressure acting therewithin merely to oscillate meniscus 240 in orifice 230. It is important that meniscus 240 does not experience static back pressure. This is important because such static back pressure otherwise increases risk that ink will leak from nozzle 190. Moreover, although transducer 250 is described as a piezoelectric transducer, transducer 20 may be any one of other types of materials or structures capable of suitably oscillating. For example, piezoelectric transducer 250 may be replaced by an electromagnetically-operated structure or a "bimorph" structure, if desired.

Still referring to FIG. 2, it is seen that as transducer 250 is stressed to position 255*b*, volume of chamber 210 decreases so that meniscus 240 extends from the orifice 230 as shown by position 245*a*. If the amplitude of the transducer 250 motion is further increased by, for example, approximately 20%, necking of the meniscus occurs with ink drops separating from nozzles 190 during movement of transducer 250 to its unstressed position 255*a*. With proper adjustment of the amplitude of transducer 250, repeated retraction of the meniscus 240 is possible without the separation of drops in the absence of a heat pulse. To ensure necking instability of meniscus 240 when a heat pulse is applied, the ink is formulated to have a surface tension which decreases with increasing temperature. Consequently, a heat pulse is applied to meniscus 240 to separate an ink droplet from nozzle 190.

Figure 3:
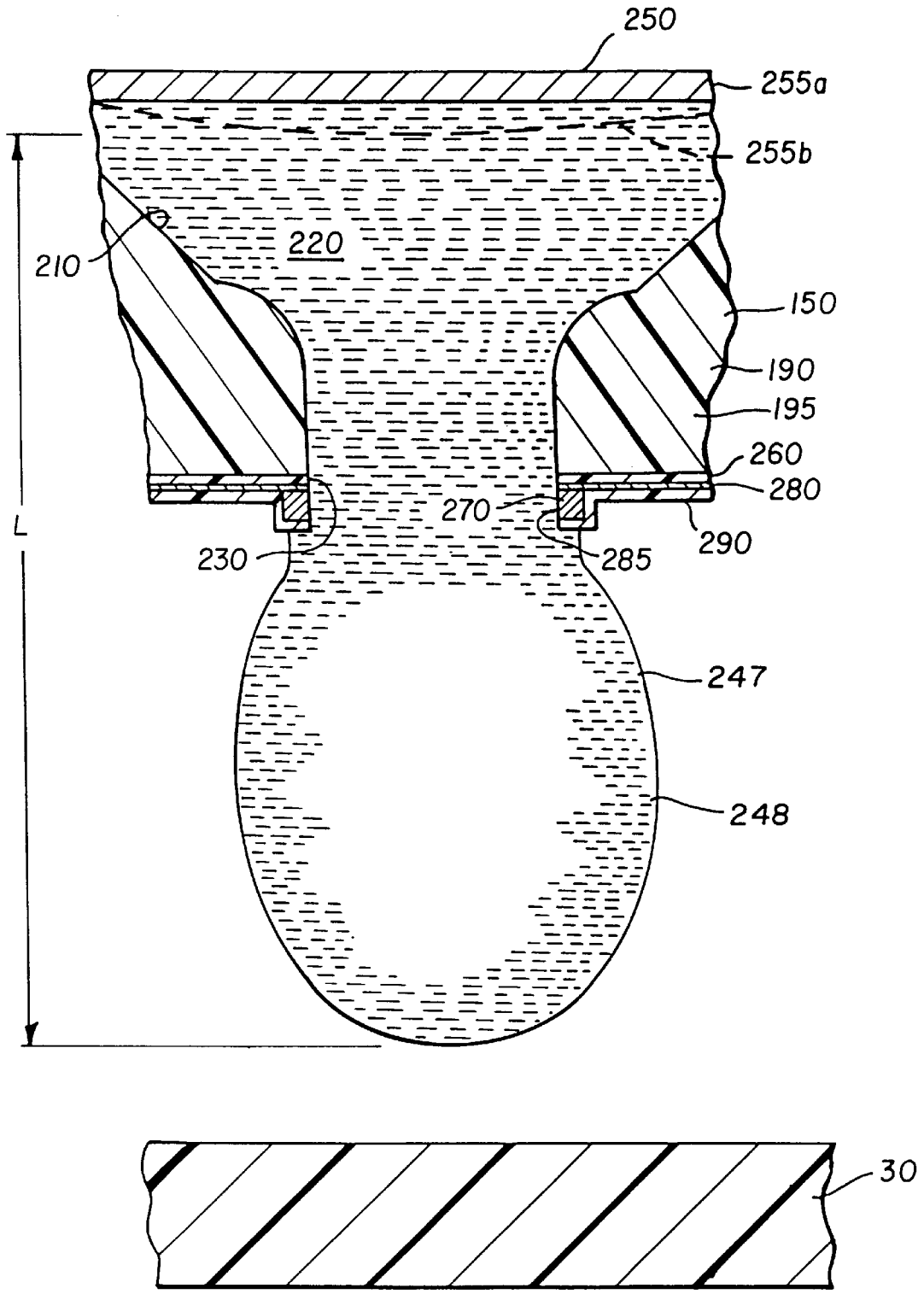
FIG. 3 is a view in vertical section of the printhead nozzle showing an ink meniscus outwardly extending from the nozzle, this view also showing a heater surrounding the nozzle and in heat transfer communication with the extended meniscus to lower surface tension of the extended ink meniscus in order to separate the extended ink meniscus from the nozzle.
Figure 4:
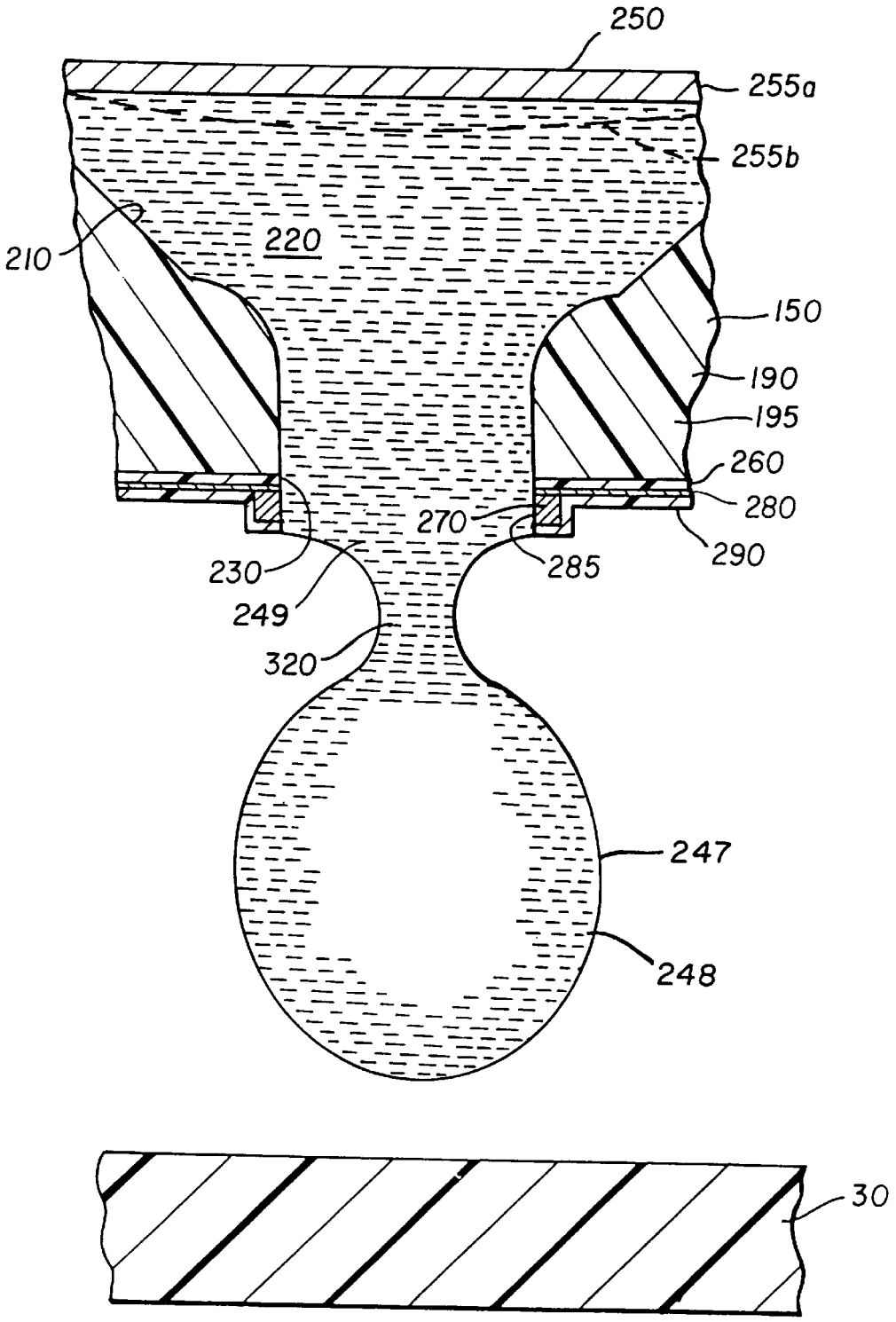
FIG. 4 is a view in vertical section of the nozzle having the meniscus further outwardly extending from the nozzle as the surface tension lowers.
Figure 4A:
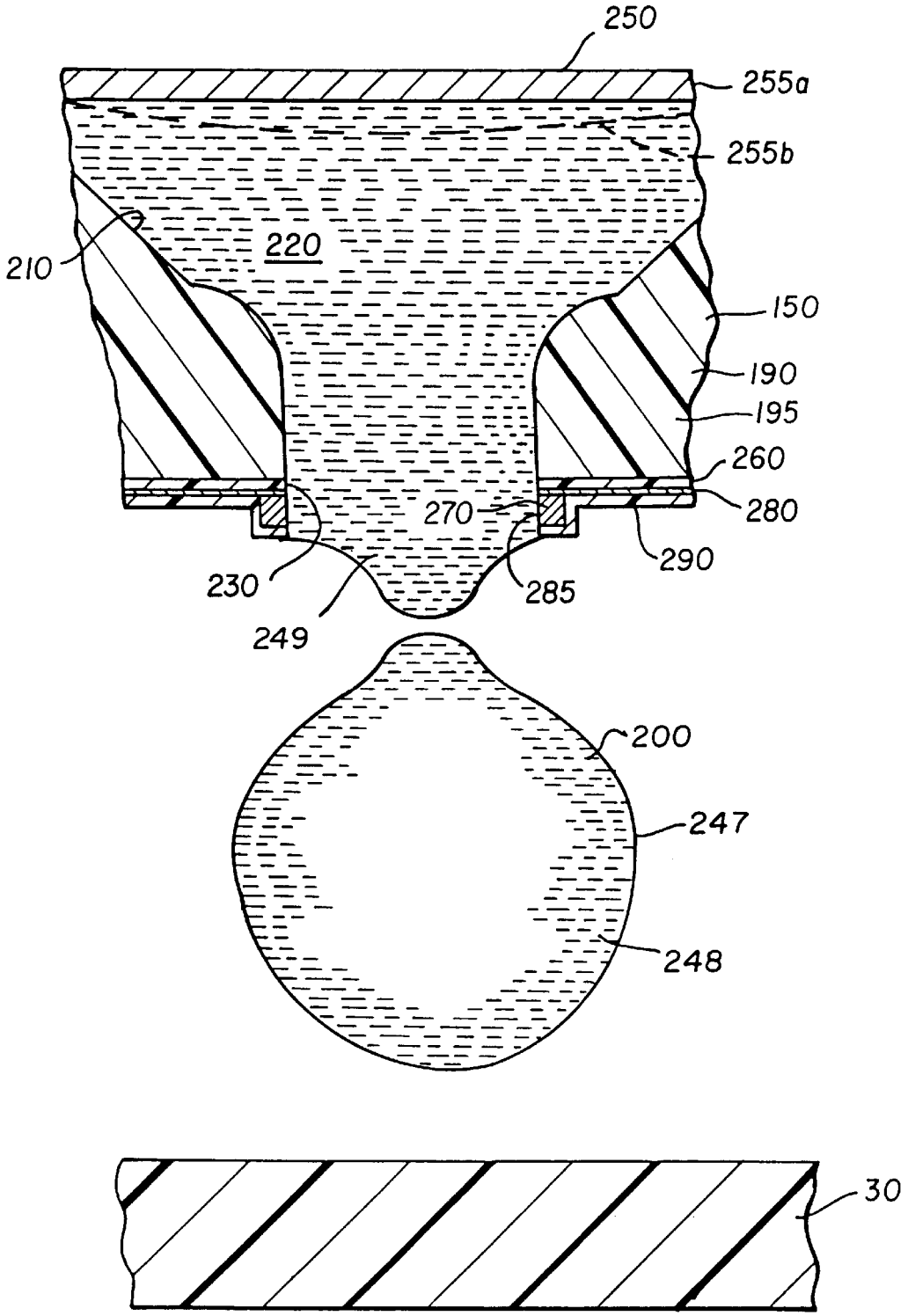
FIG. 4A is a view in vertical section of the nozzle, the meniscus shown in the act of severing from the nozzle and obtaining a generally oblong elliptical shape.

Therefore, as best seen in FIGS. 3, 4 and 4A, an ink droplet separator, such as an annular heater 270, is provided for separating meniscus from orifice 230, so that droplet 200 leaves orifice 230 and travels to recording medium 30. More specifically, an intermediate layer 260, which may be formed from silicon dioxide, covers substrate 195. Heater 270 rests on substrate 195 and preferably is in fluid communication with meniscus 240 for separating meniscus 240 from nozzle 190 by lowering surface tension of meniscus 240. Of course, heater 270 is also in heat transfer communication with meniscus 240 for heating meniscus 240. More specifically, annular heater 270 surrounds orifice 230 and is connected to a suitable electrode layer 280 which supplies electrical energy to heater 270, so that the temperature of heater 270 increases. Moreover, annular heater 270 forms a generally circular lip or orifice rim 285 encircling orifice 230. Although heater 270 is preferably annular, heater 270 may comprise one or more arcuate-shaped segments disposed adjacent to orifice 230, if desired. Heater 270 may advantageously comprise arcuate-shaped segments in order to provide directional control of the separated ink drop. By way of example only and not by way of limitation, heater 270 may be doped polysilicon. Also, by way of example only and not by way of limitation, heater 270 may be actuated for a time period of approximately 20 $\mu$s. Thus, intermediate layer 260 provides thermal and electrical insulation between heater 270 and electrode layer 280 on the one hand and substrate 195 on the other hand. In addition, an exterior protective layer 290 is also provided for protecting substrate 195, heater 270, intermediate layer 260 and electrode layer 280 from damage by resisting corrosion and fouling. By way of example only and not by way of limitation, protective layer 290 may be polytetrafluroethylene chosen for its anti-corrosive and anti-fouling properties. In the above configuration, printhead 150 is relatively simple and inexpensive to fabricate and also easily integrated into a CMOS process.

Returning briefly to FIG. 1, transducer 250 and heater 270 are controlled by the previously mentioned transducer driver circuit 90 and heater control circuit 100, respectively. Transducer driver circuit 90 and heater control circuit 100 are in turn controlled by master control circuit 80. Master control circuit 80 controls transducer driver circuit 90 so that transducer 250 oscillates at a predetermined frequency. Moreover, master control circuit 80 reads data from image memory unit 70 and applies time-varying electrical pulses to predetermined ones of heaters 270 to selectively release droplets 200 in order to form ink marks at pre-selected locations on recording medium 30. It is in this manner that printhead 150 forms image 20 according to data that was temporarily stored in image memory unit 70.

Referring to FIGS. 2, 3, 4 and 5, meniscus 240 outwardly extends from orifice 230 to a maximum distance "L" before reversal of transducer 250 motion causes meniscus 240 to retract in the absence of a heat pulse. FIGS. 3 and 4 specifically depict the case in which a heat pulse is applied via heater 270 while the meniscus 240 is outwardly expanding. Timing of the heat pulse is controlled by heater control circuit 100. The application of heat by heater 270 causes a temperature rise of the ink in the neck region 320. In this regard, temperature of neck region 320 is preferably greater than 100C but less than a temperature which would cause the ink to form a vapor bubble. Reduction in surface tension causes increased necking instability of the expanding meniscus 240 as depicted in FIG. 4. This increased necking instability, along with the reversal of motion of transducer 250 causes neck region 320 to break (i.e., sever). When this occurs, a new meniscus 240 forms after droplet separation and retracts into orifice 230. The momentum of the droplet 200 that is achieved is sufficient, with droplet velocities of 7 m/sec, to carry it to recording medium 30 for printing. The remaining newly formed ink meniscus 240 is retracted back into nozzle 190 as piezo transducer 250 returns to its unstressed position 255*a*. This newly formed meniscus 240 can then be extended during the next cycle of transducer oscillation. By way of example only and not by way of limitation, the total drop ejection cycle may be approximately 144 $\mu$s. In this manner, transducer motion and timing of heat pulses are electrically controlled by transducer driver circuit 90 and heater control circuit 100, respectively. Thus, it may be appreciated from the description hereinabove, that system 10 obtains a thermo-mechanically activated printhead 150 because heaters 270 supply thermal energy to meniscus 240 and transducer 250 supplies mechanical energy to meniscus 240 in order to produce droplet 200.

Figure 6:
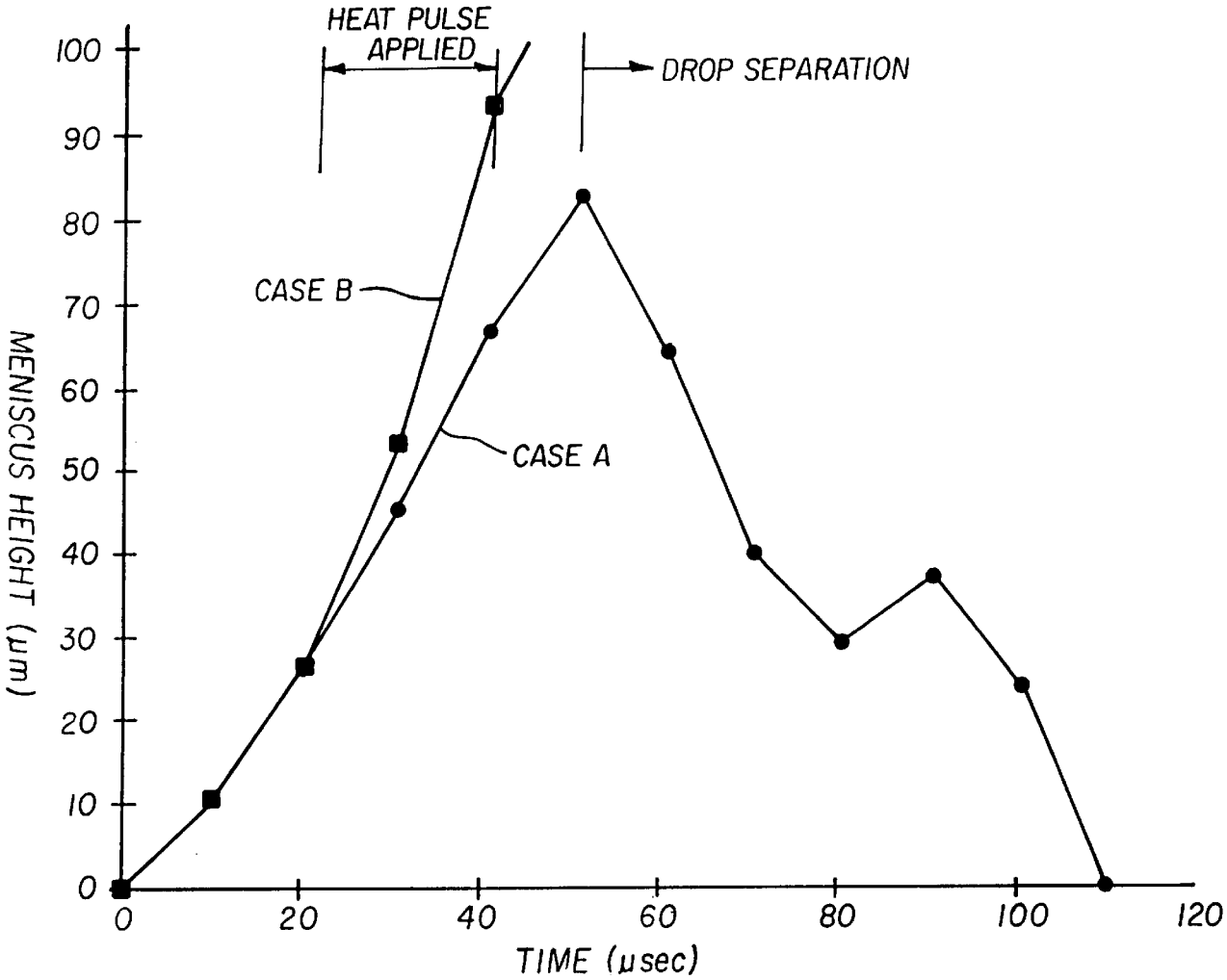
FIG. 6 is a graph showing two curves, one curve illustrating ink meniscus height as a function of time during which a heat pulse is applied by the heater to separate the meniscus from the nozzle, this graph also showing another curve illustrating ink meniscus height as a function of time during which a heat pulse is not applied to the extended ink meniscus such that the meniscus does not separate from the nozzle.

FIG. 6 is a graph illustrating height of meniscus 240 above orifice rim 285 as a function of time for the preferred embodiment of the invention after transducer 250 deflects to position 255*b* both with and without application of heat from heater 270. In the preferred embodiment of the invention, droplet 200 separates from ink body 220 approximately 30 $\mu$s after meniscus 240 begins to receive a heating pulse The information illustrated by FIG. 6 is described in greater detail hereinbelow.

Therefore, still referring to FIG. 6, the position of the tip of meniscus 240 versus time after application of the pulse to piezoelectric transducer 250 is plotted for two cases. In the first case (Case A), no heat is applied. Meniscus 240 extends out of nozzle 190 during forward motion of transducer 250 to position 255*b* and recedes when transducer 250 changes direction to position 255*a*. In the second case (Case B), an approximately 20 $\mu$s 80 mW heat pulse is applied beginning at approximately 20 $\mu$s into transducer motion. In this case, meniscus 240 shows no retraction; rather, meniscus 240 shows an increase in velocity due to the necking-off of meniscus 240. Droplet 200 separates at about 50 $\mu$s as marked on the graph with a measured drop velocity of about 7 m/sec, which is an acceptable droplet speed for printing in order to avoid droplet placement errors due to adjacent air currents. It may be appreciated that droplet separation can be achieved with a minimum threshold heat pulse width of about 10 $\mu$s and with an optimal placement of heat pulse occurring at about 20 $\mu$s before full meniscus extension "L" as would occur in the case with no heat pulse applied.

Figure 7:
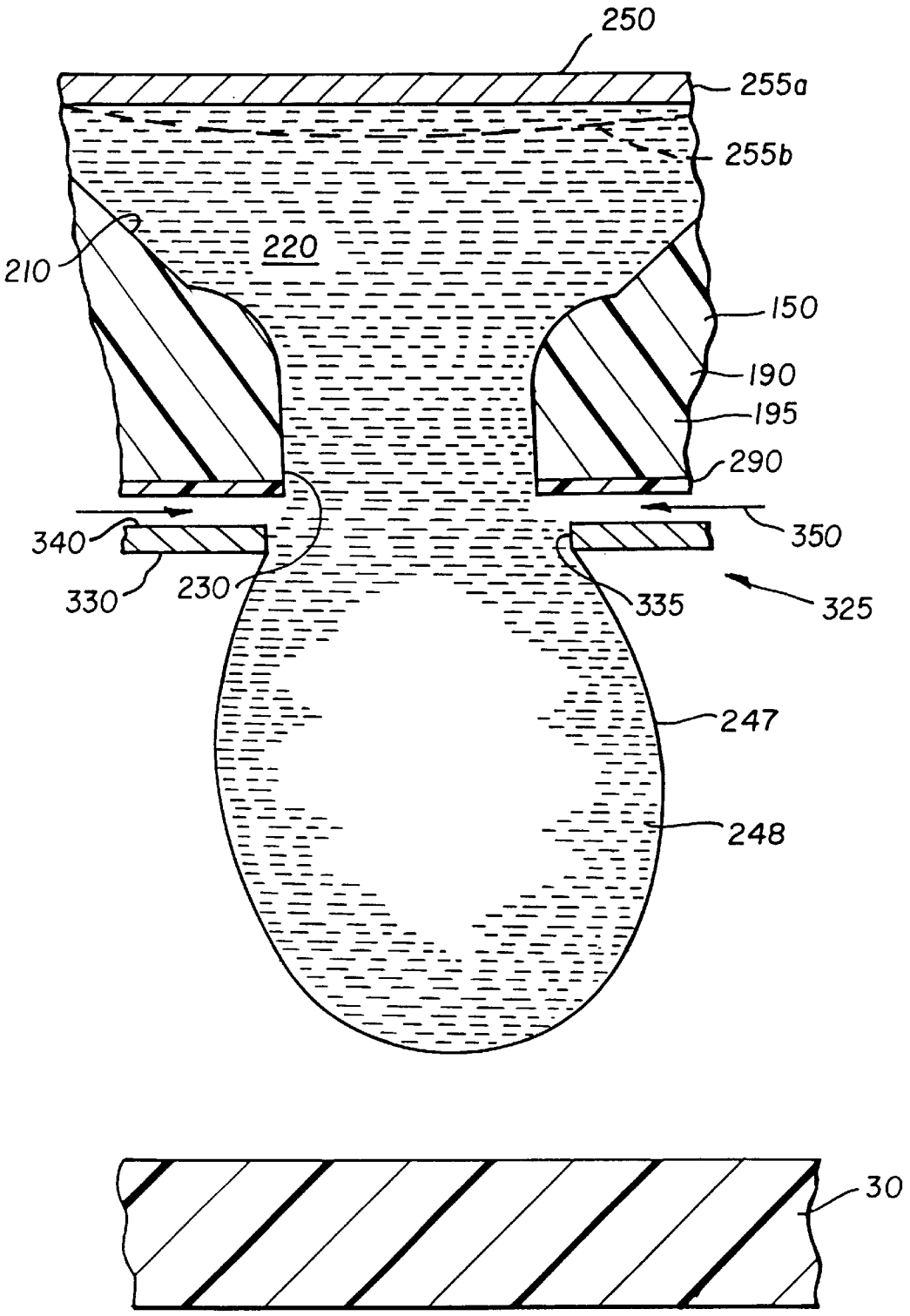
FIG. 7 is a view in vertical section of an alternative embodiment of the invention comprising an injector mechanism for injecting a surface tension reducing chemical agent into the meniscus.
Figure 8:
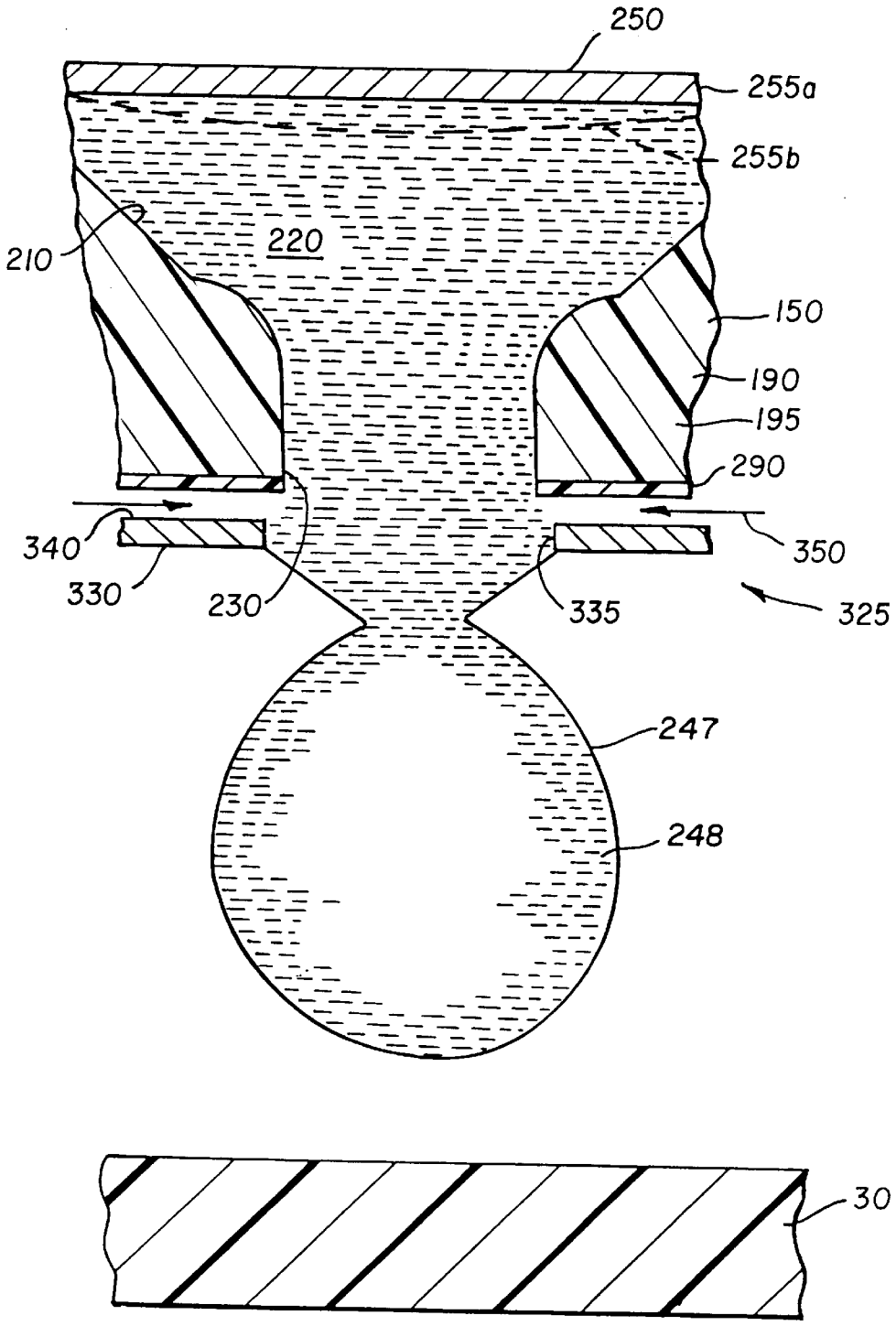
FIG. 8 is a view in vertical section of a nozzle belonging to the alternative embodiment of the invention, the meniscus outwardly extending from the nozzle.

Referring now to FIGS. 7 and 8, there is shown an alternative embodiment of the present invention comprising an injector mechanism, generally referred to as 325, for injecting a surface tension reducing chemical agent into meniscus 240. In this alternative embodiment of the invention, heaters 270 are absent. Rather, injector mechanism 325 is provided which comprises a plate member 330 having an aperture 335 for passage of extended meniscus 240 therethrough. Plate member 330 is disposed exteriorly adjacent to orifice 230 so as to define a passage 340 therebetween. Passage 340 allows a surface tension reducing chemical agent to flow into contact with meniscus 240 as meniscus 240 is pressurized and extends from orifice 230. In this regard, the chemical agent results in a meniscus surface tension preferably in the range of, but not restricted to, approximately 20 to 50 dynes/cm and flows generally in the direction of arrows 350 at an injection flow rate of approximately 0.1–1.0 pL/$\mu$s. Alternatively, a single pressure pulse may be applied to meniscus 240 rather than the plurality of pulses used to oscillate meniscus 240. In this case, the means for lowering surface tension of meniscus 240 is the previously mentioned injector mechanism 325; however, the chemical agent is selected such that the surface tension of mensicus 240 is controlled to coact with the single pulse to eject droplet 200. In this manner, ink droplet 200 separates from nozzle 190 due to the combined action of the single pulse and chemical agent. In this manner, nozzle 190 that is selected for activation is in fact activated by simultaneous application of the single pulse and the chemical agent. It may be understood from the description immediately hereinabove, meniscus 240 is not caused to oscillate.

It may be appreciated from the teachings herein that an important aspect of the present invention is that a novel and unobvious technique is provided for significantly reducing the energy required to select which ink droplets to eject. This is achieved by separating the means for selecting ink drops from the means for ensuring that selected drops separate from the body of ink. Only the drop separation mechanism must be driven by individual signals supplied to each nozzle. In addition, the drop selection mechanism can be applied simultaneously to all nozzles.

It is understood from the teachings herein that an advantage of the present invention is that there is no significant static back pressure acting on chamber 210 and ink body 220. Such static back pressure might otherwise cause inadvertent leakage of ink from orifice 230. Therefore, image forming system 10 has increased reliability by avoiding inadvertent leakage of ink.

Another advantage of the present invention is that the invention requires less heat energy than prior art thermal bubblejet printheads. This is so because the heater 270 is used to lower the surface tension of a small region (i.e., neck region 320) of the meniscus 240 rather than requiring latent heat of evaporation to form a vapor bubble. This is important for high density packing of nozzles so that heating of the substrate does not occur. Therefore, image forming system 10 uses less energy per nozzle than prior art devices.

Yet another advantage of the present invention is that heaters 270 are longer-lived because the low power levels that are used prevents cavitation damage due to collapse of vapor bubbles and kogation damage due to burned ink depositing on heater surfaces.

A further advantage of the present invention is that only a single transducer 250 is used rather than a plurality of transducers each assigned to a respective one of chambers 210. Therefore complexity is reduced compared to prior art devices. This is possible because transducer 250 does not in itself eject droplet 200; rather, transducer 250 merely oscillates meniscus 240 so that meniscus 240 is pressurized and moves to position 245*a* in preparation for ejection. It is the lowering of surface tension by means of heater 270 that finally allows droplet 200 to be ejected. Use of a single transducer 250 to merely oscillate meniscus 240 rather than to eject droplet. 200 eliminates so-called "cross- talk" between chambers 210 during droplet ejection because the heat applied to the meniscus at one nozzle selected for actuation does not affect the meniscus at an adjacent nozzle. In other words, there is no significant heat transfer between adjacent nozzles. Elimination of cross-talk between chambers 210 allows more chambers 210 per unit volume of printhead 150. More chambers 210 per unit volume of printhead 150 results in a denser packing of chambers 210 in printhead 150, which in turn allows for higher image resolution.

An additional advantage of the present invention is that the velocity of the drop of approximately 7 m/sec is large enough that no additional means of moving drops to receiver are necessary in contrast to prior art low energy use printing systems.

The invention has been described in detail with particular reference to certain preferred embodiments thereof, but it should be understood that variations and modifications can be effected within the spirit and scope of the invention. For example, ink body 220 need not be in a liquid state at room temperature. That is, solid "hot melt" inks can be used, if desired, by heating printhead 150 and reservoir 130 above the melting point of such a solid "hot melt" ink. As another example, system 10 may comprise a transducer and heater in combination with a chemical agent injector mechanism in the same device, if desired.

Moreover, as is evident from the foregoing description, certain other aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

Therefore, what is provided is an image forming system and method for forming an image on a recording medium, the system including a thermo-mechanically activated DOD (Drop On Demand) printhead which conserves power.

PARTS LIST

| | |
|---|---|
| L | maximum meniscus extension distance in absence of heating pulse |
| 10 | image forming system |
| 20 | image |
| 30 | recording medium |
| 40 | image source |
| 50 | image processor |
| 60 | halftoning unit |
| 70 | image memory unit |
| 80 | master control circuit |
| 90 | transducer driver circuit |
| 100 | heater control circuit |
| 110 | controller |
| 120 | ink pressure regulator |
| 130 | ink reservoir |
| 140 | conduit |
| 150 | printhead |
| 160 | transport control unit |
| 170 | transport mechanism |
| 180 | rollers |
| 190 | nozzle |
| 195 | substrate |
| 200 | ink droplet |
| 210 | chamber |
| 220 | ink body |
| 230 | nozzle orifice |
| 240 | ink meniscus |
| 242 | surface area of ink meniscus |
| 245a | first position of meniscus |
| 245b | second position of meniscus |
| 247 | expanded surface area of ink meniscus |
| 248 | extended ink meniscus body |
| 249 | posterior portion of extended ink meniscus body |
| 250 | transducer |
| 255a | first position of transducer |
| 255b | second position of transducer |
| 260 | intermediate layer |
| 270 | heater |

-continued

| PARTS LIST | |
|---|---|
| 280 | electrode layer |
| 285 | orifice rim |
| 290 | protective layer |
| 300 | surface area of ink meniscus |
| 305 | expanded surface area of ink meniscus |
| 310 | extended ink meniscus body |
| 315 | posterior portion of extended ink meniscus body |
| 320 | necked portion |
| 325 | injector mechanism |
| 330 | plate member |
| 335 | aperture |
| 340 | passage |
| 350 | arrow |

What is claimed is:

1. An image forming system, comprising:

(a) a transducer adapted to alternately pressurize and depressurize an ink body so that an ink meniscus having a predetermined surface tension extends from the ink body as the ink body is pressurized and so that the meniscus retracts to the ink body as the ink body is depressurized, the meniscus forming a neck portion thereof as the meniscus extends from the ink body; and (b) an ink droplet separator coupled to said transducer and in communication with the neck portion of the meniscus for lowering the surface tension of the neck portion of the meniscus while the meniscus is extending from the ink body, whereby said droplet separator separates the meniscus from the ink body to form an ink droplet as the surface tension of the neck portion is lowered and as the ink body is depressurized.

2. The system of claim 1, wherein said droplet separator comprises a heater for heating the neck portion of the meniscus.

3. The system of claim 2, further comprising a first control circuit connected to said heater for controlling said heater, so that said heater controllably heats the neck portion of the meniscus at a predetermined time.

4. The system of claim 1, wherein said droplet separator comprises an injector mechanism for injecting a surface tension reducing agent into the neck portion of the meniscus.

5. The system of claim 1, further comprising a second control circuit connected to said transducer for controlling said transducer, so that said transducer controllably pressurizes and depressurizes the ink body.

6. An inkjet image forming system, comprising (a) a nozzle defining a chamber therein for holding an ink body, said nozzle having a nozzle orifice in communication with the chamber, the orifice accommodating an ink meniscus of predetermined surface tension connected to the ink body;

(b) an oscillatable transducer in fluid communication with the ink body for alternately pressurizing and depressurizing the ink body, so that the meniscus extends from the orifice as the ink body is pressurized and forms a neck portion thereof and retracts into the orifice as the ink body is depressurized; and (c) a droplet separator coupled to said transducer and in communication with the neck portion of the meniscus for lowering the surface tension of the neck portion of the meniscus while the meniscus is extending from the orifice, whereby said separator separates the meniscus from the ink body to form an ink droplet as the surface tension of the neck portion is lowered and as the ink body is depressurized.

7. The system of claim 6, wherein said droplet separator comprises a heater for heating the neck portion of the meniscus.

8. The system of claim 7, further comprising a heater control circuit connected to said heater for controlling said heater, so that said heater controllably heats the neck portion of the meniscus at a predetermined time.

9. The system of claim 7, wherein said heater surrounds the nozzle.

10. The system of claim 6, further comprising a driver control circuit connected to said transducer for controlling said transducer, so that said transducer controllably oscillates to alternately pressurize and depressurize the ink body.

11. The system of claim 6, wherein said transducer is a piezoelectric transducer.

12. The system of claim 6, wherein said transducer is a bimorph transducer.

13. The system of claim 6, wherein said transducer is an electro-magnetically operated transducer.

14. The system of claim 6, wherein said droplet separator comprises an injector mechanism for injecting a surface tension reducing chemical agent into the neck portion of the meniscus.

15. The system of claim 14, wherein said injector mechanism is capable of injecting a surface tension reducing agent at a flow rate between approximately 0.1 and 1.0 pL/$\mu$s.

16. A drop-on-demand inkjet image forming system for forming an image on a recording medium, comprising:

(a) a printhead;

(b) a plurality of nozzles integrally connected to said printhead, each nozzle defining a chamber therein for holding an ink body, each of said nozzles having a nozzle orifice in communication with respective ones of the chambers, each orifice accommodating an ink meniscus of predetermined surface tension connected to the ink body;

(c) a single oscillatable piezoelectric transducer in fluid communication with all the ink bodies for alternately pressurizing and depressurizing the ink bodies, so that each of the menisci extends from the orifice associated therewith as each of the ink bodies is pressurized and forms a neck portion thereof and retracts into the orifice as the ink bodies are depressurized;

(d) a plurality of heaters associated with said single transducer and in heat transfer communication with respective ones of the neck portions of the ink menisci while the menisci are extending from their respective orifices for lowering the surface tension of the neck portion of a selected one of the menisci and (e) a heater control circuit connected to each of said heaters for actuating a selected one of said heaters, so that said selected one of said heaters controllably heats the selected one of the menisci, whereby the surface tension of the neck portion of the selected one of the menisci is lowered as the neck portion of the selected one of the menisci is heated, whereby the neck portion of the selected one of the menisci severs as the surface tension thereof lowers and the menisci retract into their respective orifices, and whereby the selected one of the menisci separates from the orifice associated therewith as the neck portion thereof severs in order to form an ink droplet.

17. The system of claim 16, wherein said heaters surround respective ones of said nozzles for applying heat to any of the neck portions of the menisci.

18. The system of claim 16, wherein said heater control circuit controls each of said heaters, so that heat is applied to the neck portions at a predetermined time after pressurization of said menisci.

19. The system of claim 18, wherein said heater control circuit controls each of said heaters, so that heat is applied to the neck portion at a time immediately preceding maximum outwardly extension of the selected one of the menisci from the orifices.

20. The system of claim 16, further comprising a driver control circuit connected to said transducer for controlling said transducer, so that said transducer controllably oscillates to alternately pressurize and depressurize the menisci.

21. A drop on demand print head, comprising:

(a) a plurality of drop-emitter nozzles;

(b) a body of ink associated with said nozzles;

(c) a pressurizing device adapted to pressurize and depressurize said body of ink, to form an extended meniscus having a neck portion thereof of predetermined surface tension while said body of ink is pressurized and to form a retracted meniscus while said body of ink is depressurized; and (d) drop separation apparatus selectively operable upon the neck portion of the meniscus of predetermined nozzles when the meniscus is extended to lower the surface tension of the neck portion while the ink body is depressurized so as to cause ink from the selected nozzles to separate as drops from the body of ink, while allowing ink to be retained in non-selected nozzles.

22. The print head of claim 21, wherein said pressurizing device intermittently forms an extended meniscus with an air/ink interface.

23. An image forming method, comprising the steps of:

(a) pressurizing an ink body by operating a transducer so that an ink meniscus extends from the ink body and forms a neck portion thereof as the meniscus extends from the ink body, the meniscus having a predetermined surface tension;

(b) depressurizing the ink body by operating the transducer, so that the ink meniscus retracts to the ink body; and (c) lowering the surface tension of the neck portion of the meniscus while the meniscus is extending from the ink body by operating an ink droplet separator in communication with the neck portion of the meniscus, whereby the droplet separator separates the meniscus from the ink body to form an ink droplet as the surface tension of the neck portion is lowered and as the ink body is depressurized.

24. The method of claim 23, wherein the step of lowering the surface tension comprises the step of lowering the surface tension by operating a droplet separator having a heater for heating the neck portion of the meniscus.

25. The method of claim 24, further comprising the step of controlling the heater by operating a first control circuit connected to the heater, so that the heater controllably heats the neck portion of the meniscus at a predetermined time.

26. The method of claim 23, wherein the step of lowering the surface tension comprises the step of lowering the surface tension by operating an droplet separator having an injector mechanism for injecting a surface tension reducing agent into the neck portion of the meniscus.

27. The method of claim 23, further comprising the step of controlling the transducer by operating a second control circuit connected to the transducer, so that the transducer controllably pressurizes and depressurizes the ink body.

28. An inkjet image forming method, comprising the steps of:

(a) accommodating an ink meniscus of predetermined surface tension in a nozzle orifice defined by a nozzle, the meniscus connected to an ink body held in a chamber defined by the nozzle, the nozzle orifice being in communication with the chamber;

(b) alternately pressurizing and depressurizing the ink body by operating an oscillatable transducer in fluid communication with the ink body, so that the meniscus extends from the orifice as the meniscus is pressurized and forms a neck portion thereof and retracts into the orifice as the ink body is depressurized; and (c) lowering the surface tension of the neck portion of the meniscus while the meniscus is extending from the orifice by operating a droplet separator in communication with the neck portion of the meniscus, whereby the separator separates the meniscus from the ink body to form an ink droplet as the surface tension of the neck portion is lowered and as the ink body is depressurized.

29. The method of claim 28, wherein the step of lowering the surface tension of the meniscus comprises the step of lowering the surface tension by operating a droplet separator having a heater for heating the neck portion of the meniscus.

30. The method of claim 29, further comprising the step of controlling the heater by operating a heater control circuit connected to the heater, so that the heater controllably heats the neck portion of the meniscus at a predetermined time.

31. The method of claim 28, wherein the step of lowering the surface tension of the neck portion of the meniscus comprises the step of lowering the surface tension by operating a droplet separator having a heater for heating the meniscus, the heater surrounding the nozzle.

32. The method of claim 28, further comprising the step of controlling the transducer by operating a driver control circuit connected to the transducer, so that the transducer controllably oscillates to alternately pressurize and depressurize the ink body.

33. The method of claim 28, wherein the step of alternately pressurizing and depressurizing the ink body by operating an oscillatable transducer in fluid communication with the ink body comprises the step of operating a piezoelectric transducer.

34. The method of claim 28, wherein the step of alternately pressurizing and depressurizing the ink body by operating an oscillatable transducer in fluid communication with the ink body comprises the step of operating a bimorph transducer.

35. The method of claim 28, wherein the step of alternately pressurizing and depressurizing the ink body by operating an oscillatable transducer in fluid communication with the ink body comprises the step of operating an electro-magnetic transducer.

36. The method of claim 28, wherein the step of lowering the surface tension of the meniscus comprises the step of lowering the surface tension by operating an injector mechanism for injecting a surface tension reducing chemical agent into the neck portion of the meniscus.

37. The method of claim 36, wherein the step of lowering the surface tension by operating an injector mechanism comprises the step of injecting a surface tension reducing agent at a flow rate between approximately 0.1 and 1.0 pL/$\mu$s.

38. A drop-on-demand inkjet image forming method for forming an image on a recording medium, comprising the steps of:

(a) operating a printhead having a plurality of nozzles integrally connected to the printhead, each nozzle defining a chamber therein for holding an ink body, each of the nozzles having a nozzle orifice in communication with respective ones of the chambers, each orifice accommodating an ink meniscus of predetermined surface tension connected to the ink body;

(b) operating a single oscillatable piezoelectric transducer in fluid communication with all the ink bodies for alternately pressurizing and depressurizing the ink bodies, so that each of the menisci extends from its respective orifice as each of the ink bodies is pressurized and forms a neck portion thereof and retracts into the orifice associated therewith as the ink bodies are depressurized;

(c) operating a plurality of heaters associated with the single transducer and in heat transfer communication with respective ones of the neck portions of the ink menisci while the menisci are extending from their respective orifices for lowering the surface tension of the neck portion of a selected one of the menisci; and (d) operating a heater control circuit connected to each of the heaters for actuating a selected one of the heaters, so that the selected one of the heaters controllably heats the selected one of the menisci, whereby the surface tension of the neck portion of the selected one of the menisci is lowered as the neck portion of the selected one of the menisci is heated, whereby the neck portion of the selected one of the menisci severs as the surface tension thereof lowers and the menisci retract into their respective orifices, and whereby the selected one of the menisci separates from the orifice associated therewith as the neck portion thereof severs in order to form an ink droplet.

39. The method of claim 38, wherein the step of operating a plurality of heaters comprises the step of operating a plurality of heaters surrounding respective ones of the nozzles for applying heat to any of the neck portions of the menisci.

40. The method of claim 38, wherein the step of operating the heater control circuit comprises the step of controlling each of the heaters, so that heat is applied to the neck portions at a predetermined time after pressurization of the menisci.

41. The method of claim 38, wherein the step of operating the heater control circuit comprises the step of controlling each of the heaters, so that heat is applied to the neck portion at a time immediately preceding maximum outwardly extension of the selected one of the menisci from the orifices.

42. The method of claim 38, further comprising the step of operating a driver control circuit connected to the transducer for controlling the transducer, so that the transducer controllably oscillates to alternately pressurize and depressurize the menisci.

43. A method of producing ink droplets from a plurality of drop-emitter nozzles, said method comprising the steps of:

(a) providing a body of ink associated with said nozzles;

(b) providing a pressurizing device adapted to pressurize and depressurize said body of ink to form an extended meniscus having a neck portion thereof of predetermined surface tension while said body of ink is pressurized and to form a retracted meniscus while said body of ink is depressurized; and (c) operating upon the neck portion of the meniscus of predetermined nozzles when the meniscus is extended to lower the surface tension of the neck portion while the ink body is depressurized so as to cause ink from the selected nozzles to separate as drops from the body of ink, while allowing ink to be retained in non-selected nozzles.

44. The method of claim 43, wherein the step of subjecting said body of ink to a pulsating pressure above ambient, to intermittently form an extended meniscus comprises the step of subjecting said body of ink to a pulsating pressure above ambient, to intermittently form an extended meniscus with an air/ink interface.

* * * * *